United States Patent [19]

Bässler

[11] 4,274,925

[45] Jun. 23, 1981

[54] METHOD OF ELECTROPLATING AND HONING LIGHT-ALLOY WORKPIECES

[75] Inventor: Wolfgang Bässler, Wiesloch, Fed. Rep. of Germany

[73] Assignees: Mahle GmbH, Stuttgart; Institut für Werkzeugmaschinen und Betriebstechnik Universität Karlsruhe, Karlsruhe, both of Fed. Rep. of Germany

[21] Appl. No.: 131,691

[22] Filed: Mar. 19, 1980

[30] Foreign Application Priority Data

Mar. 27, 1979 [DE] Fed. Rep. of Germany ..... 2911979

[51] Int. Cl.[3] ..... C25D 5/22; C25D 5/30; C25D 7/04

[52] U.S. Cl. ..... 204/26; 204/DIG. 10

[58] Field of Search ..... 204/26, DIG. 10

[56] References Cited

U.S. PATENT DOCUMENTS

| | | | |
|---|---|---|---|
| 3,022,232 | 2/1962 | Bailey | 204/26 |
| 3,751,346 | 8/1973 | Ellis | 204/26 |
| 3,769,181 | 10/1973 | Biora | 204/DIG. 10 |
| 3,922,207 | 11/1975 | Lowrey | 204/26 |

*Primary Examiner*—T. M. Tufariello

*Attorney, Agent, or Firm*—Murray and Whisenhunt

[57] ABSTRACT

A method for electroplating and mechanically honing surfaces of a light-alloy workpiece is provided comprising placing the workpiece within a honing machine having honing stones and an electrolytic circuit including an electrolyte, applying to said workpiece a first coating by electrolytic deposition within said electrolyte with the honing stones disengaged from said surfaces, and effecting simultaneous honing and electrolytic deposition of a second coating by means of said electrolyte. In this manner the deposition of the necessary basic coating is combined with the procedural step of the simultaneous electroplating and mechanical honing in such a way that the basic coating is deposited in the hone-forming machine itself and with the same electrolytic fluid, so that there is no need for a preliminary plating in an additional unit that is separate from the hone-forming machine.

1 Claim, 3 Drawing Figures

METHOD OF ELECTROPLATING AND HONING LIGHT-ALLOY WORKPIECES

BACKGROUND TO THE INVENTION

The invention relates to a method for the simultaneous electroplating and mechanical honing of surfaces of a light-alloy workpiece and such as is indicated as being known from the periodical "Products Finishing", 1974, pages 48 to 57.

STATEMENT OF PRIOR ART

The simultaneous electroplating and mechanical honing of mostly hollow-cylindrical surfaces is generally called hone-forming among experts. The advantages of this method lie in a layered composition of the coating deposited as well as in a more rapid build-up of this coating as compared to pure electroplating because the constant grinding of the honing stones over the surface causes this surface to be electrically activated and levelled. In this regard, reference is made to DE PS No. 20 29 646 and No. DE OS No. 22 37 834 of the prior art. If the known method is applied to light-alloy workpieces, more especially such made of aluminium, it is however necessary to deposit thereon a thin basic coating in an independent procedural step prior to the simultaneous electroplating and mechanical honing, onto which coating the coating proper can only then be deposited by hone-forming. In the above-mentioned reference, there is proposed for this purpose a preliminary zincate coating so as to bring about good adhesion conditions for the coating to be deposited by the hone-forming method.

Our own experiments have confirmed the necessity of an intermediate coating. It has turned out that it is not sufficient to clean the surface to be plated, for example if aluminium is the basic material. If a cleaned surface of an aluminium workpiece is simultaneously honed and electroplated, then the relatively soft aluminium surface is damaged by the honing stones in the starting phase and there does not come about a satisfactory adhesion of the coating deposited, e.g. chromium on the aluminium basic material. The intermediate coating hitherto provided for this purpose—a zincate coating—had to be deposited in a separate device and with a fluid other than that which is used during hone-forming. This made the plating of light-alloy workpieces according to the hone-forming method particularly complicated.

OBJECT OF THE INVENTION

It is the object of the invention to indicate a method which allows the necessary basic coating to be produced with as low an expenditure as possible.

SUMMARY OF THE INVENTION

According to the invention we provide a method of electroplating and mechanically honing surfaces of a light-alloy workpiece, comprising placing the workpiece within a honing machine having honing stones and an electrolytic circuit including an electrolyte, applying to said workpiece a first coating by electrolytic deposition within said electrolyte with the honing stones disengaged from said surfaces, and effecting simultaneous honing and electrolytic deposition of a second coating by means of said electrolyte.

In this manner the deposition of the necessary basic coating is combined with the procedural step of the simultaneous electroplating and mechanical honing in such a way that the basic coating is deposited in the hone-forming machine itself and with the same electrolytic fluid, so that there is no need for a preliminary plating in an additional unit that is separate from the hone-forming machine.

BRIEF DESCRIPTION OF DRAWINGS

Further developments and advantages of the invention will emerge from the following description of an exemplified embodiment shown diagrammatically in the drawings, in which.

DESCRIPTION OF PREFERRED EMBODIMENTS

Figure 1:
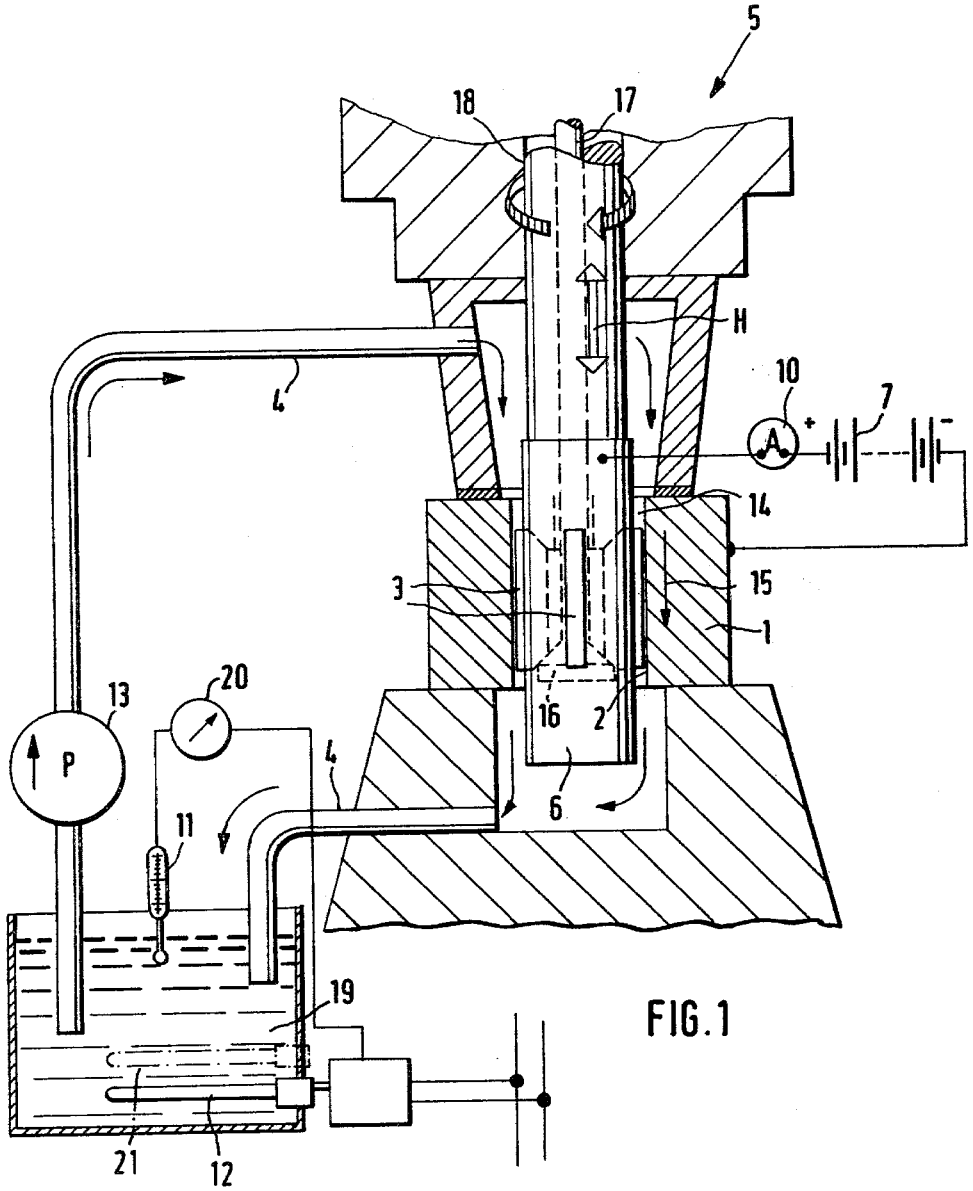
FIG. 1 shows a diagrammatical procedural construction for the performance of the plating method according to the invention.
Figure 2:
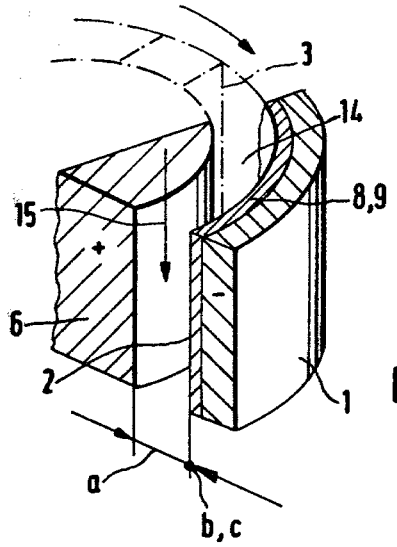
FIG. 2 shows a partial section from the electrode forming the working gap and the workpiece surface acting as the counter electrode.

In the procedural construction shown diagrammatically in FIG. 1, there is indicated a hone-forming machine 5 with an arrangement for the defined reception of a light-alloy workpiece 1 and with a spindle nose which carries a rotatable honing stick 18 which can be moved up and down and at whose lower end there is arranged a cylindrical electrode 6 with several honing stones 3 which extend along generating lines of the electrode cylinder. The honing stones are adjustable in the radial direction, for which purpose a pull rod 17 is arranged in an axially movable manner in the interiors of the honing stick and the electrode. In the simplified representation shown here, there is attached to the lower end of the pull rod, for expanding the honing stones or for applying pressure thereto, a pressure cone 16 which co-operates with an oblique face on the underside of the honing stones. The honing stones, which are also bevelled on the top, co-operate in an expanding sense with a cone which is stationarily mounted in the interior of the electrode. When the pull rod 17 is unloaded, the honing stones can be contracted to the inside, for example by the force of a spring not shown. The electrode and the honing stones can oscillate within certain limits for the correction of minor positional inaccuracies, for which purpose at least one joint is fitted in the honing stick, which is however not shown herein. This entire arrangement is known 'per se', for which reason it is shown only in a diagrammatically simplified manner.

Concentrically around the electrode with the honing stones there is mounted the light-alloy workpiece 1, whose surface that is to be coated is a hollow cylinder in the exemplified embodiment shown. The light-alloy workpiece is not only held inside the hone-forming machine so as to be defined in relation to the electrode but is also incorporated in a fluid-tight manner in a closed circuit 4 for the electrolytic fluid 19. For this reason, there is formed beneath and above the workpiece a fluid chamber which is sealed towards the exterior and into and through which the honing stick and the electrode can be axially moved. The annular working gap 14 formed between the electrode 6 and the surface 2 to be coated is vertical in the hone-forming machine. The flow through the fluid circuit 4 occurs in such a way—as indicated by flow arrows—that the stream passes through the working gap 14 in a falling manner over the entire length thereof (flow arrow 15). The electroytic fluid emerging at the bottom of the working gap is collected in a fluid chamber and is returned through a line to a collecting tank, in which the particles which have been mechanically broken off by the honing stones can settle. The forced circulation of the fluid in the direction of circulation shown is ensured by a circulating pump. The delivery of the pump is controllable so as to allow the flow rate of the electrolytic fluid through the working gap to be set to optimum velocity values. For setting and monitoring an optimum electrolyte temperature, there is provided in the collecting tank receiving the electrolytic fluid a thermometer 11 which acts through a temperature monitoring device 20 on a heating source 12 fed by electric current. If the temperature of the electrolytic fluid drops below a desired value, which can be set on the temperature monitoring device 20, the electrolytic fluid is re-heated to the required nominal value through the heating source 12 and the latter is then automatically switched off.

There is furthermore provided in the general arrangement a direct-current source 7, whose positive pole is connected to the electrode 6 and whose negative pole is connected to the light-alloy workpiece 1. It is therefore necessary that at least the electrode 6 should be arranged within the hone-forming machine so as to be electrically insulated. An ampere meter 10 is connected in the electric circuit for monitoring the current density within the working gap 14.

In one exemplified embodiment of the plating method according to the invention, the bore of a workpiece made of aluminium was provided with a chromium coating. The aluminium material had the designation Al Si 12 Cu Mg Ni; the chromium was deposited from an electrolytic fluid of conventional composition. Prior to the insertion of the light-alloy workpiece into the hone-forming machine, the surface to be plated was thermally pre-treated in detergent, lye and acid so as to remove any grease and oxide films. The light-alloy workpiece thus pre-treated was then inserted into a known 'per se' hone-forming machine shown diagrammatically in FIG. 1. During the initially effected pre-plating step, the honing stones 3 are lifted from the surface to be plated, but the honing spindle and the electrode 6 rotate and are moved up and down so as to prevent the formation of shadow images of the honing stones on the surface to be plated. The pre-plating step is naturally carried out with the same electrolytic fluid 19 as the subsequent main plating during hone-forming. The other parameters of the procedure during the pre-plating step are also largely identical with the subsequent hone-forming. This applies initially to the gap width a of the working gap 14 between the electrode 6 and the surface 2 to be plated which ranges optimally from approximately 1 to 2.5 mm. This dimension takes into account the endeavour to obtain as narrow a gap as possible. With a specified current, the current density is increased on curved surfaces to be plated as the gap width is reduced, which has a favourable effect on the rate of deposition. On the other hand, the nodule formation in the electrodeposited coating increases as the gap width is reduced, which is undesirable. The indicated value of 1 to 2.5 mm is an acceptable compromise value between the two opposed requirements for a maximum current density and a minimum nodule formation. Like the gap width, the flow geometry of the electrolyte which is forcibly passed through the working gap is the same during the pre-plating step as during the subsequent hone-forming. Instead of a flow that is falling over the entire length, a rising flow or a flow that is simultaneously falling and rising during the supply and the removal of the electrolytic fluid at the medium level of the working gap would be conceivable. However, it has been shown that a flow that falls over the entire length of the working gap ensures a minimum of roundness and cylindricity defects.

Taking into consideration the cross section of the working gap, the delivery of the circulating pump 13 within the fluid circuit 4 has been set in such a way that there comes about an electrolytic fluid flow rate through the working gap of approximately 2.5 to 3 m/sec., at least during the pre-plating step but preferably also during hone-forming. At high flow rates, a more uniform coating growth is attainable at high current densities, particularly when the electrolyte temperatures are relatively low, which will be discussed in more detail below. Although an increase in the flow rate to above 2.5 to 3 m/sec. does not bring an increase in the rate of deposition, the formation of the coating surface is more uniform at higher rates.

In consideration of the fact that the same electrolytic fluid is used both for the pre-plating step and for the hone-forming proper, the idea suggests itself to use the same fluid circuit for both procedural steps and thus to carry out both procedural steps at the same electrolyte temperature. Electrolyte temperatures in the region of approximately 55° are usual. It turns out that at temperatures ranging from approximately 30° to 40° C., more especially of approximately 35° C., it is possible to attain a reduced roughness of the deposited coating, a better current efficiency and a faster coating growth. In the diagrammatical construction shown in FIG. 1, a temperature control for the electrolytic fluid is provided for this reason. If, as a result of the functional sequence of the procedure, the heat input into the electrolytic fluid is such that this fluid is unaidedly heated beyond the optimum temperature range, then the electrolytic fluid has to be artificially and automatically cooled down by the temperature control by means of a cooling coil 21 which is indicated in dash-dotted lines in the collecting tank. If it is desired that the temperature at which the pre-plating step is carried out should be different from that at which the actual hone-forming occurs, then two separate electrolytic fluid collecting tanks with separate temperature controls must be provided. The return line from the hone-forming machine as well as the intake connection of the circulating pump would each have to be equipped with a change-over valve as well as with a branch line into respectively one of the collecting tanks.

Thanks to the constant mechanical treatment of the surface of the electrodeposited coating during hone-forming, the surface thereof is constantly electrically activated and smoothed, as has been mentioned. As a result thereof, it is possible to allow high current densities, which bring about a rapid film growth, without any danger of a wild nodule growth. Taking into consideration the fact that the pre-plating step is followed by the mechanical smoothing of the first coat, it is also possible to allow in the same way during the pre-plating step high current densities ranging from approximately 250 to 750 $A/dm^2$. If there is an optimum co-ordination of the procedural sequence, it is thus possible to deposit 20 $\mu$/min of chromium.

Figure 3:
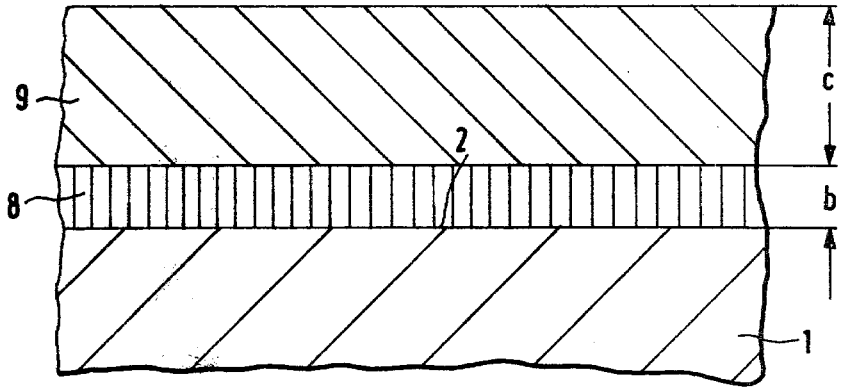
FIG. 3 shows a cross section, in a considerably enlarged representation, through a completed deposition according to the invention.

The thickness b of the first coating 8 deposited during the pre-plating step should be such that after the honing stones have been placed on this first coating, these are reliably unable to reach the basic material located therebeneath. In fact, it has turned out during the hone-forming of light-alloy workpiece surfaces that the honing stones roughen the surface, which is initially still unplated, to a very considerable extent, which is detrimental to an orderly and smooth coat build-up. The first coating is to prevent such roughening of the basic material by the honing stones. A coat thickness of approximately 40 μm for the first coating 8 will certainly be adequate for this purpose. This coating is thus considerably thinner than the second coating 9 of the dimension a which is deposited during hone-forming. While there is no mechanical honing during the pre-plating step, there are formed in the surface 2 of the workpiece 1 nodules which grow substantially vertically from the surface that is plated into space. The nodules also grow in the lateral sense, and more and more nodules are formed until the entire surface is full of nodules without any gaps being left. When there is no constant mechanical grinding of the surface that has been formed, the structure of the coat is substantially columnar, which is meant to be indicated in FIG. 3 by way of a hatching that is directed vertically to the surface 2. The uniform coat thickness of the first coating shown in FIG. 3 does not come about until the subsequent honing of this coating is effected. In reality, the first coating is relatively uneven before honing commences. The indicated coat thickness dimension of approximately 40 μm has also been chosen in consideration of the fact that even at the thinnest points there is provided a coat thickness which will reliably give support. In consideration of coat thickness growth rates of approximately 20 μm/min, which are attainable with an optimum process control, a pre-plating time of approximately 2 minutes may be already sufficient.

Following the pre-plating step, the honing stones 3 are positioned by means of the pull rod 17. The honing stick 18 carries out an axial lift H during the rotation, which lift is adjustable. It has turned out that the maximum honing stone lift H produces a minimum of macro-faults on the surface plated following the deposition. The contact pressure for the honing stones must also be optimally set. Indeed, the coat thickness growth is higher at low honing stone contact pressures, and the attainable surface is also smoother. However, at higher contact pressures, fewer macro-faults as well as an improved adhesion of the coat are attainable. Empirically established values can constitute a good compromise between the opposing requirements.

It goes without saying that a nickel coating could be deposited instead of a chromium coating, which would of course necessitate the use of a different electrolytic fluid. In view of the fact that the metal nickel has a position within the electrochemical series that is different from chromium, it may however be necessary, for attaining adequate adhesion, to deposit a zincate coating in a separate procedural step prior to the deposition of a nickel coating in a pre-plating step. However, even after the deposition of such a buffer coating, the pre-plating in the hone-forming machine without the application of the honing stones is appropriate because the zincate coat can also be removed relatively quickly if the honing stones are applied immediately.

I claim:

1. A method of electrodepositing chromium on the internal surface of a cylindrical aluminium base alloy workpiece comprising (a) placing the workpiece within a honing machine having honing stones and an electrolytic circuit including an electrolyte for said metal (b) circulating said electrolyte over said surface at a speed of 5 to 6 meters per second at a current density of 250 to 750 A/dm$^2$ and a temperature of 30° to 40° C. whilst the honing stones are disengaged from the depositing metal and until a first coating of said metal is produced having a thickness of 20 to 50 μm.

(c) moving the honing stones radially so as to engage said deposited metal while continuing deposition of said metal under approximately the same conditions until a second coating is applied to the first coating with a thickness at least equal to that of the first coating.

* * * * *